United States Patent [19]

Boston et al.

[11] Patent Number: 4,539,102

[45] Date of Patent: Sep. 3, 1985

[54] METHOD AND APPARATUS FOR SEPARATING ARTIFICIAL DRILL CUTTINGS FROM NATURAL DRILL CUTTINGS

[75] Inventors: William G. Boston, Dallas; Robert T. Strong, Plano, both of Tex.

[73] Assignee: Mobil Oil Corporation, New York, N.Y.

[21] Appl. No.: 549,848

[22] Filed: Nov. 9, 1983

[51] Int. Cl.[3] ..... B03C 1/16; B03C 1/30

[52] U.S. Cl. ..... 209/38; 209/214; 209/215; 209/219; 209/229; 209/254; 209/259; 209/636; 209/933; 141/280; 166/66.4

[58] Field of Search ..... 209/10, 38, 214, 215, 209/219, 228, 229, 259, 551, 636, 933, 254; 198/396, 397; 141/34, 125, 280; 166/65 M

[56] References Cited

U.S. PATENT DOCUMENTS

| | | | |
|---|---|---|---|
| 468,540 | 2/1892 | Cane | 209/219 |
| 536,226 | 3/1895 | McKinnon | 209/219 |
| 2,276,075 | 3/1942 | Woensch | 209/38 |
| 3,269,189 | 8/1966 | Monk | 209/10 |
| 3,328,233 | 6/1967 | Martinez | 209/219 |
| 3,661,259 | 5/1972 | Reynolds | 209/551 |
| 4,031,004 | 6/1977 | Sommer, Jr. et al. | 209/636 |
| 4,302,245 | 11/1981 | Winters | 209/214 |

*Primary Examiner*—David L. Lacey

*Attorney, Agent, or Firm*—Alexander J. McKillop; Michael G. Gilman; Charles J. Speciale

[57] ABSTRACT

A method and apparatus are disclosed for removing and counting artificial drill cuttings from a returning drill mud containing a mixture of both artificial and natural drill cuttings. The artificial drill cuttings are injected into the drilling fluid and supplied to a drill string and have magnetic properties, while the natural drill cuttings do not. A rotary magnetic drum having a first endless belt travelling therearound receives the cuttings mixture and the magnetic artificial cuttings adhere to the first belt by being attracted to the drum, while the natural drill cuttings do not, thereby permitting separation of the two. The artificial cuttings are removed from the drum by a second endless belt cooperating with the first endless belt to define a nip between them. The belts positively engage with and remove the artificial cuttings from the drum.

20 Claims, 11 Drawing Figures

METHOD AND APPARATUS FOR SEPARATING ARTIFICIAL DRILL CUTTINGS FROM NATURAL DRILL CUTTINGS

CROSS-REFERENCE TO RELATED APPLICATIONS

The present invention is related to subject matter described and claimed in U.S. application Ser. No. 529,192, filed Sept. 6, 1983, entitled "Method of Monitoring The Growth of Cutting Beds In Angled Well Bores", and assigned to the same assignee as the present invention.

BACKGROUND AND FIELD OF THE INVENTION

The present invention relates to a method and apparatus for separating artificial drill cuttings introduced into a drilling fluid, ("mud"), which is pumped into a drilling string in a borehole, from a mixture of artificial and natural drill cuttings contained in drilling fluid returning to the surface from the borehole.

In recent years the pressure for production of increased oil and gas has led to increased use of wells drilled at angles with respect to the vertical, sometimes called deviated wells. This is done for a variety of reasons, for example, to effect a wide area of coverage from a single well head, such as an off-shore oil platform. Other reasons for drilling at angles include avoiding drilling through large upthrusts of material located directly over formations of interest, and avoiding having to drill through corrosive material, such as found in salt domes. The art recognizes that there are other applications of drilling at angles to the vertical as well.

The typical well drilling procedure, particularly in exploration for oil, gas and other minerals involves the rotation of a drill bit at the end of a long tubular drill string. A drilling fluid or "mud" is pumped down the center of the drill string, to exit around the hollow drill bit, and carries the cuttings drilled from the subsurface formation back to the surface for removal. The mud also provides a cooling effect to the drill head. In a well drilled along the vertical the cuttings are carried to the surface by the mud passing around the drill head on all sides. However, in a well drilled at an angle to the vertical, the tendency is for the mud to flow upwardly along the upper side of the drill string because it is typically of lower density than the metallic drill string. The absence of a mud current on the lower side of the drill string allows a bed of cuttings to build up under the drill string. This can be a severe problem if the cuttings bed builds up to such an extent that the drill string is partially or fully embedded in the cuttings bed. When one tries to remove the drill head, which is typically of larger diameter than the drill string, the cuttings bed prevents or impedes its removal.

Numerous expedients have been suggested for ensuring that cuttings are removed properly from a well drilled at an angle to the vertical and some of these are successful; however, one area which the art has not addressed is the provision of a method for determining whether the cuttings are, in fact being properly removed from a well, so as to determine whether any of these methods should be used, and, if they are used, whether or not they are working effectively.

The above-referenced U.S. application discloses and claims a method of monitoring the growth of a cuttings bed in an angled well. The method employs the step of injecting artificial drill cuttings, which have a density comparable to natural drill cuttings, but which are distinguishable, e.g. magnetically, from natural drill cuttings, into a drilling fluid, e.g., mud, pumped down the drill string during well drilling, and monitoring the rate of return of the artificial cuttings with respect to the rate of injection to determine the efficacy of the removal of natural cuttings generated during drilling. By practicing this method, one can obtain an indication on whether a cuttings bed is increasing or decreasing in size or is substantially stable in size, and an indication of whether natural drill cuttings are being properly removed from a borehole during drilling.

In practicing the above method, it is desirable to recycle and reuse the artificial drill cuttings for reasons of economy. Accordingly, one object of the present invention is the provision of a method and apparatus for economically and reliably separating the artificial drill cuttings for reuse from a mixture containing both artificial and natural drill cuttings contained in a returning drilling fluid.

Another object of the invention is the provision of a method and apparatus for economically and reliably determining a rate and/or total amount of artificial drill cuttings which are separated from a mixture containing both artificial and natural drill cuttings contained in a returning drilling fluid.

Another object of the invention is the provision of a method and apparatus for economically and reliably separating materials having magnetic properties from a mixture of those materials and others which do not have magnetic properties.

SUMMARY OF THE INVENTION

The above objects are attained by the invention which utilizes a rotating magnetic surface for materials separation. The rotating surface receives a mixture of materials, some of the materials of the mixture having magnetic properties and others not having magnetic properties. The materials having magnetic properties are attracted to and held by the rotating magnetic surface, while the non-magnetic materials fall off the rotating surface by gravity to achieve material separation. Thereafter, the magnetic materials held to the rotating surface are removed, by cooperating endless belts, and are counted and collected. If the mixture of materials includes artificial drill cuttings having magnetic properties and natural drill cuttings having no, magnetic properties, the rotating magnetic surface and cooperating endless belts easily separate artificial from natural drill cuttings.

The above-described objects, features and advantages of the invention, as well as others, will be more clearly recognized from the following detailed description of the invention, which is provided in connection with the accompanying drawings.

DETAILED DESCRIPTION OF THE INVENTION

Figure 1:
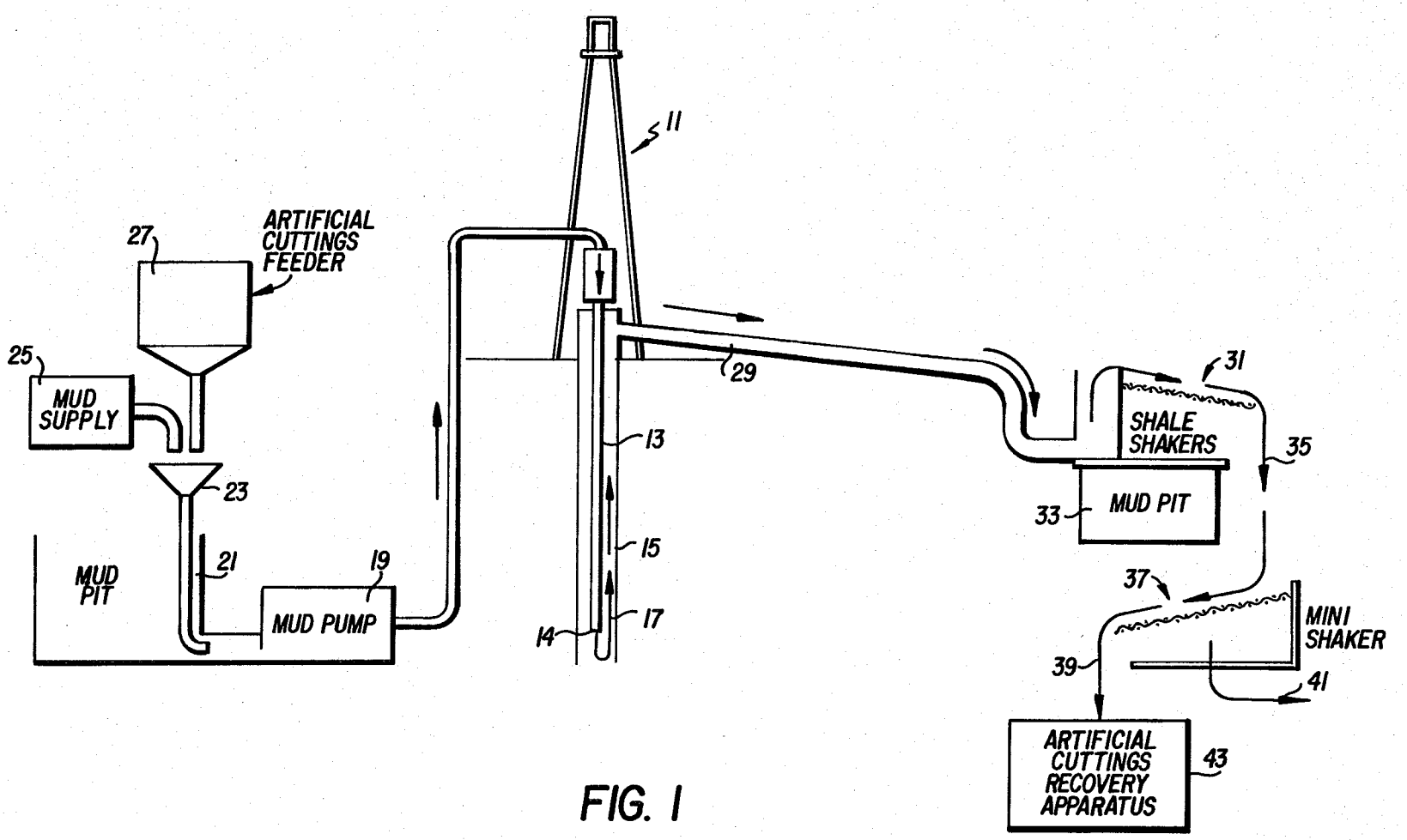
FIG. 1 illustrates in schematic form a drilling process employing the method and apparatus of the invention.

FIG. 1 illustrates the overall process in which the method and apparatus of the invention are used. As shown therein, a conventional drilling apparatus 11 operates a drill string 13, which has on its distal end a cutting head 14 for drilling borehole 15. As is conventional, a drilling mud is supplied to the drill pipe string 13 from a mud pump 19. The drilling mud, supplied to drill string 13, exits the drill string at the distal end thereof adjacent the cutting head 14 and is flushed to the surface of borehole 15 along the path indicated by the arrows in FIG. 1. The drilling mud which returns from the borehole 15, and which contains drill cuttings is supplied to a series of shale shakers 31, also called main shakers, which separate the drill cuttings from the mud. A mud pit 33 is provided below the shale shakers 31 to receive the mud separated from the returning mud and cuttings mixture. The returned mud is then recycled from the mud pit 33 and supplied to suction pit 21 for subsequent reuse.

In accordance with the method described in the above-referenced application, artificial drill cuttings are added to the drilling mud by means of an artificial cuttings feeder 27. The artificial cuttings are supplied into a chute 23, which also may receive fresh mud from mud supply 25 and provides this to the input of mud pump 19. As a consequence, the returning drilling mud passing through mud return conduit 29 and into the shale shakers 31, contains a mixture of both artificial cuttings added by feeder 27 to the drilling mud and natural drill cuttings generated by the rotation of cutting head 14 in the borehole. This cuttings mixture 35 is, in accordance with the invention, supplied to a mini-shaker 37, which separates smaller sized natural cuttings, i.e. those of a size generally smaller than the size of the artificial cuttings, from the mixture 35. Consequently, the mini-shaker produces a first output stream of smaller sized natural cuttings 41 and an additional stream of materials 39, which is still a mixture of both natural and artificial drill cuttings. This mixture 39 of drill cuttings is then processed by an artificial cuttings recovery apparatus 43, which separates the artificial drill cuttings for counting and reuse from the natural drill cuttings which are dumped into a shale pit.

Figure 2:
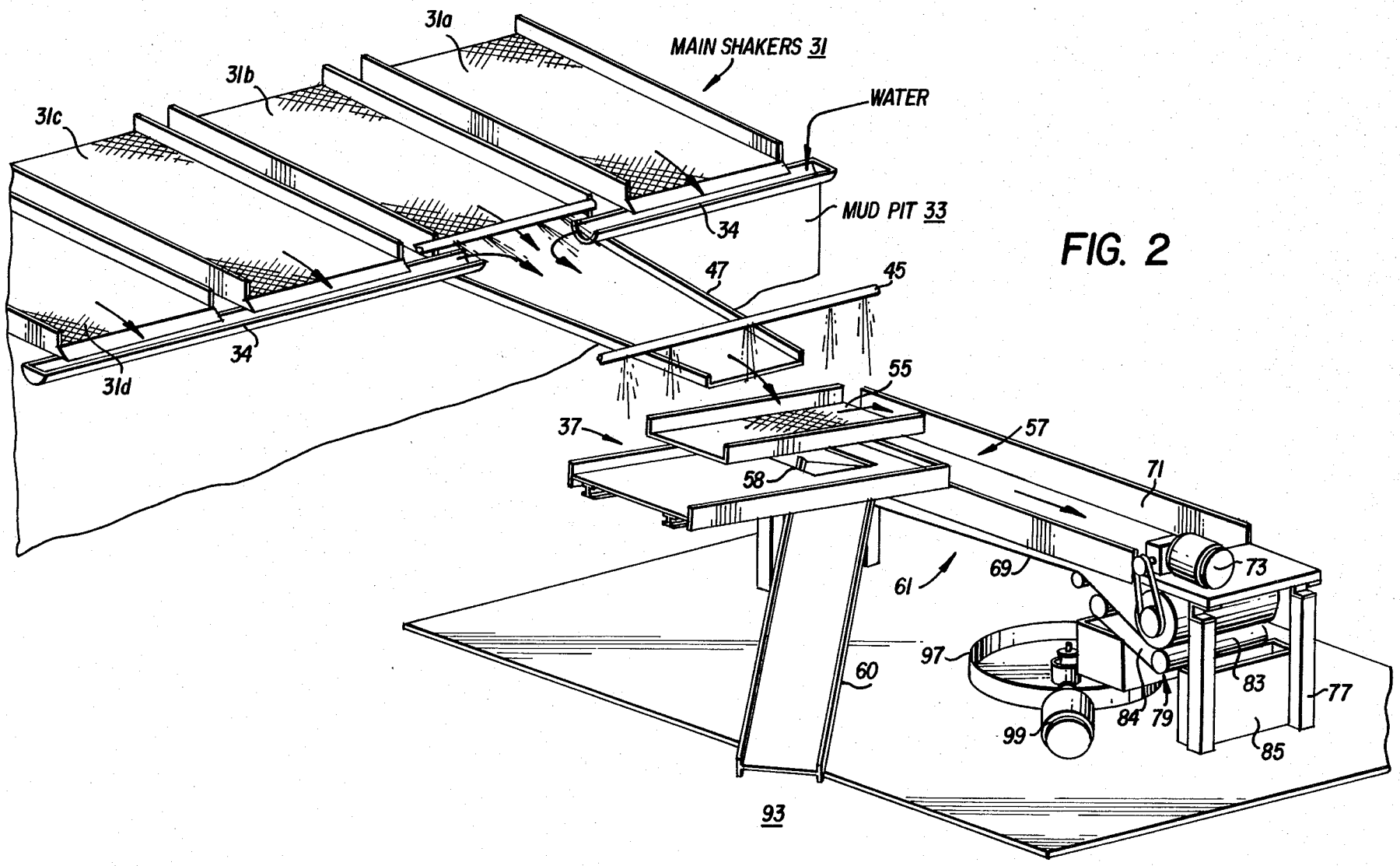
FIG. 2 is a perspective view of the shale shaker, mini-shaker and artificial cuttings recovery apparatus illustrated in FIG. 1.
Figure 5:
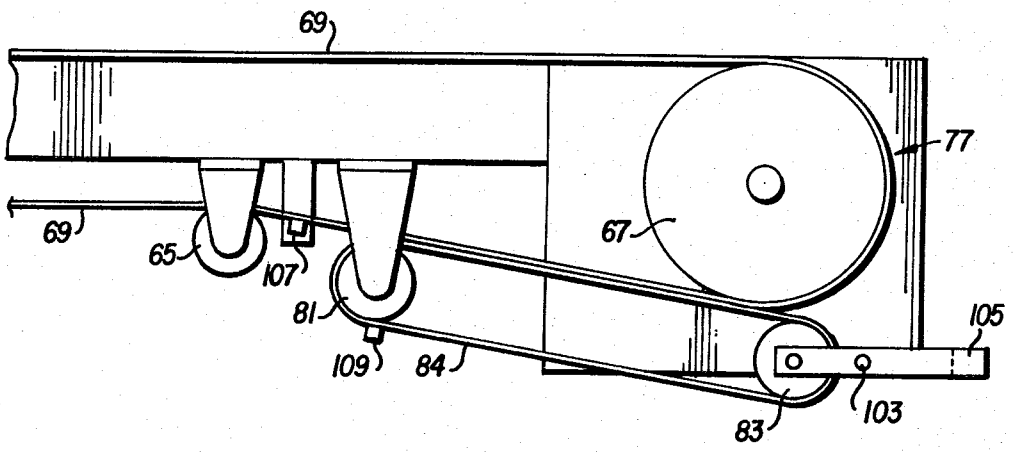
FIG. 5 is an enlarged detailed side view of a portion of the apparatus illustrated in FIG. 3.
Figure 3:
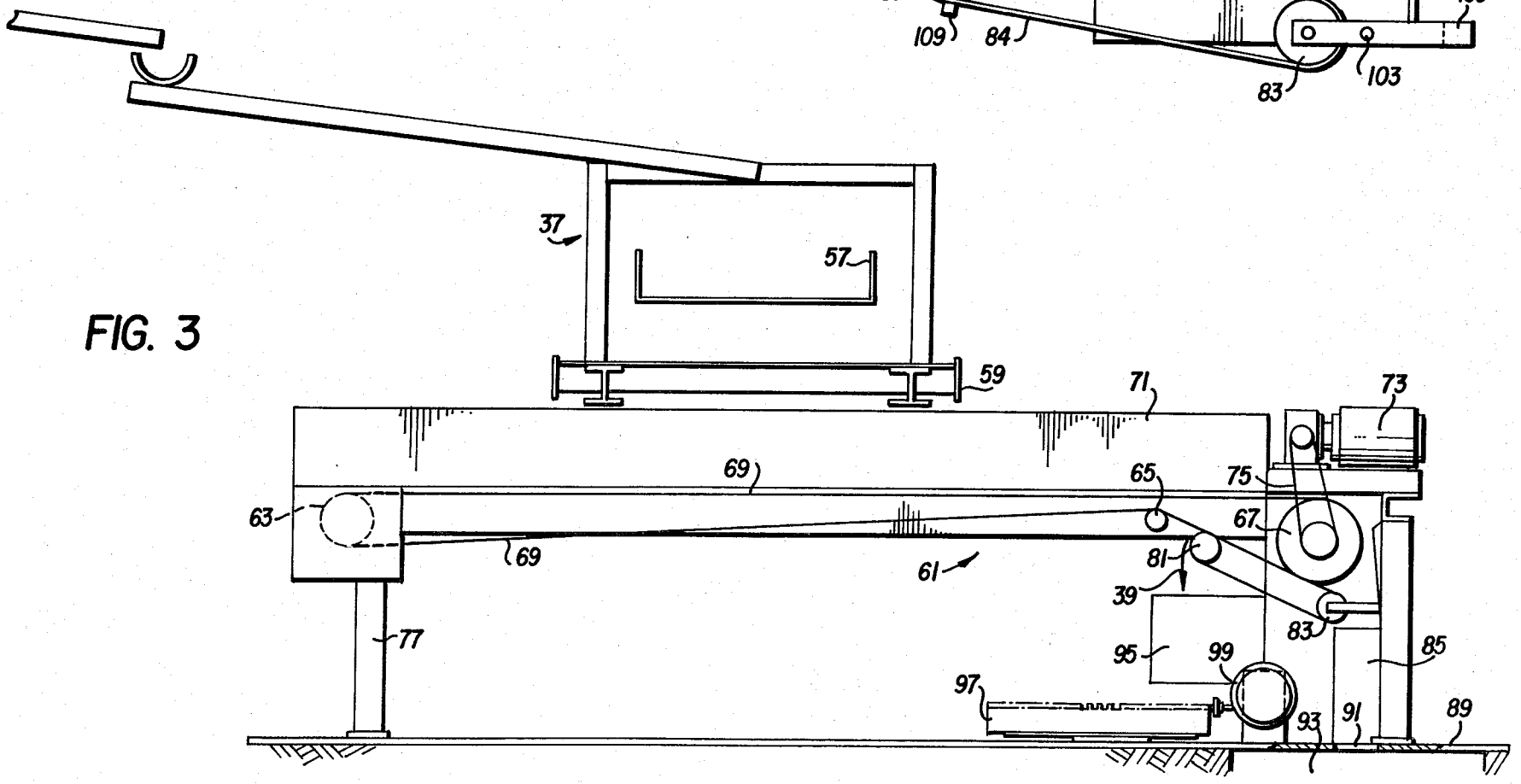
FIG. 3 is a side view of the artificial cuttings recovery apparatus illustrated in FIG. 1.
Figure 4:
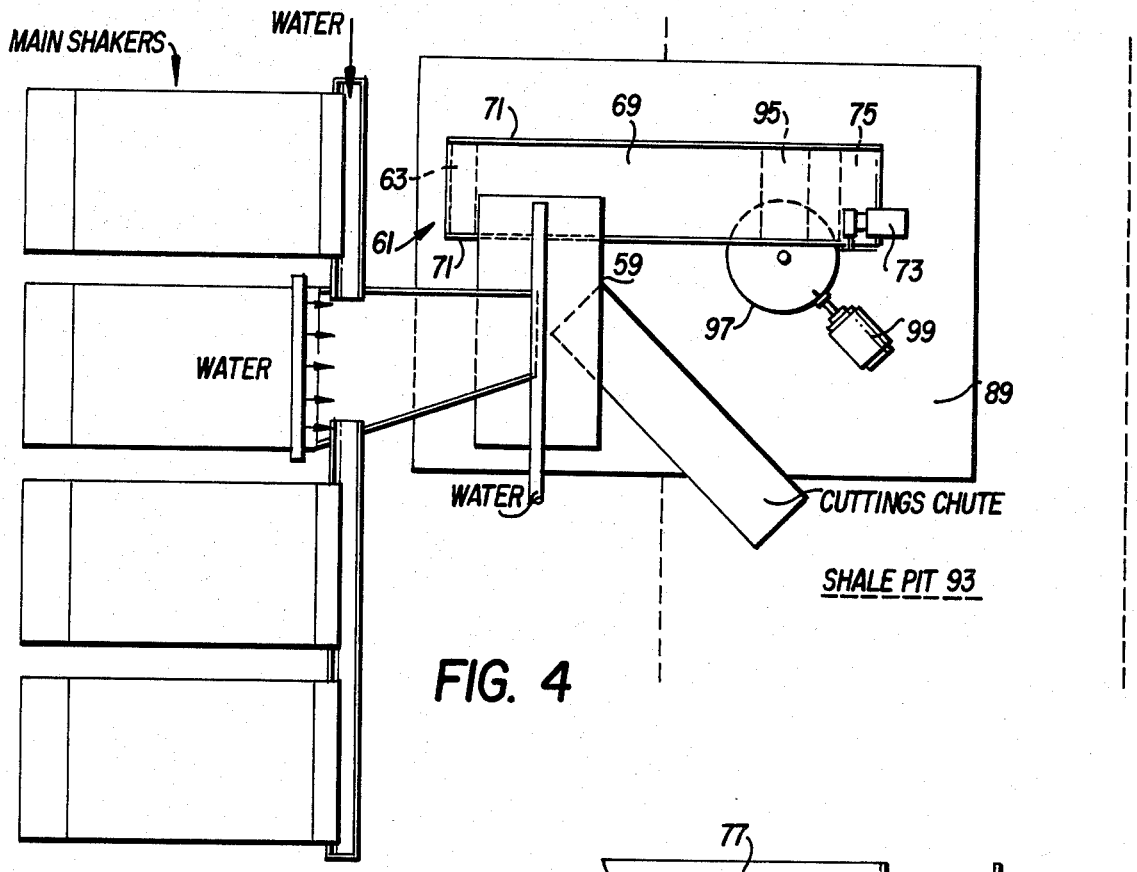
FIG. 4 is a top view of the artificial cuttings recovery apparatus illustrated in FIG. 1.

FIG. 2 illustrates the arrangement of the shale shakers 31, mini-shaker 37, and cutting recovery apparatus 43 in greater detail. The shale or main shakers 31, are conventional devices which receive the drilling mud and mixture of artificial and natural drill cuttings, and separate the cuttings mixture from the drilling mud with the latter falling through the perforated beds of the shale shakers into a mud pit 33. The drilling mud in mud pit 33 is then processed and returned, as discussed above, to the suction pit 21 for reuse. Although four main shakers 31 are shown, the number used can vary as desired. Because the main shakers are conventional devices well known to those skilled in the art, detailed descriptions thereof are not provided herein. The cuttings mixture 35 separated by shale shakers 31 either directly falls into chute 47 in the case of main shaker **31*b*, or first falls into a water trough 34 and then into chute 47 in the case of main shakers 31*a*, 31*c* and 31*d*. The mixture 35 is guided by chute 47, and is further wet by a water spray from conduit 45, and then falls onto a vibrating screen 55 of a mini-shaker 37. The mini-shaker is mounted on a support (not shown). The construction and operation of mini-shaker 37 is also, per se, well known in the art, and accordingly a detailed description of its operation will not be provided. A conventional SWACO (trade name) mini-shaker can be employed and adapted to the remainder of the system. However, a conventional mini-shaker normally uses a fine vibrating screen to remove and discharge fine materials from a mixture whereas the mini-shaker 37 uses a course vibrating screen 55, which allows the smaller sized natural drill cuttings 41 to fall therethrough to a shaker outlet tray 57 having an outlet hole 58 therein whereby they then fall onto an outlet chute 60 and into a shale pit 93. The remaining mixture on vibrating screen 55 is a mixture of larger sized natural drill cuttings and the artificial drill cuttings. These cuttings are guided by a mini-shaker chute (not shown) provided at the outlet of vibrating screen 55 to an artificial cuttings recovery apparatus, partially shown in FIG. 2 and depicted in greater detail in FIGS. 3–11**.

The artificial cuttings recovery apparatus includes a conveyor assembly 61 disposed perpendicularly to the materials conveying direction of the mini-shaker 37. The materials mixture 39 at the outlet of the mini-shaker 37 cascades onto a conveyor belt 69, arranged perpendicularly to the longitudinal direction of mini-shaker 37. Conveyor belt 69 is an endless belt running around rollers 63, 65 and a drum 67. The drive for conveyor belt 69 is provided by drum 67, which is coupled to a motor 73 by a sprocket and chain or a pulley and belt arrangement 75.

The materials mixture 39 supplied to the conveyor belt 69 from the mini-shaker 37 is guided and held on the conveyor belt by upstanding sidewalls 71, which are arranged on opposite side edges of the conveyor belt 69 along its upper travel path, that is on the top side of roller 63 and drum 67. The conveyor assembly 61, including belt 69, rollers 63, 65 and drum 67, are mounted to and supported by a support frame 77.

Drum 67 contains a magnetic outer peripheral surface. The artificial drill cuttings, in turn, are formed of a material having magnetic properties and have a density and size similar to natural cuttings. For example, the artificial cuttings may comprise a composite material of iron powder and nylon. The natural drill cuttings, by contrast, do not have magnetic properties. Thus, as the materials mixture is conveyed by conveyor belt 69 towards and around magnetic drum 67, the artificial drill cuttings will continue to cling to belt 69 by virtue of the magnetic surface of drum 67, as the conveyor belt 69 passes around drum 67. The natural drill cuttings, however, will fall off the end of conveyor assembly 61, that is off the peripheral surface of the belt covered drum 67, and be collected by a shale chute 85, which guides the natural drill cuttings to an opening 91 provided in a support platform, beneath which the shale pit 93 is located.

The artificial drill cuttings, which are held to conveyor belt 69 by the magnetic attraction provided by drum 67, are positively separated by a nip provided between conveyor belt 69 and an auxiliary endless belt 84, which forms part of an auxiliary conveyor 79. The auxiliary belt 84 rotates about a fixed roller 81 and a movable roller 83 and is driven by its contact with conveyor belt 69. The artificial cuttings removed by the nip between belts 69 and 84 are then dropped into an artificial cuttings feeder/counter 95. This device includes a magnetic or other article detector, for detecting the passage of each artificial cutting therethrough. This count value is then used, for example, in the method described in the above-referenced application, together with a signal representing the amount of artificial cuttings introduced into the drilling mud, to measure whether a cuttings bed is increasing or decreasing in size or is stable. After passing through the feeder counter apparatus 95, the artificial cuttings 39 are then dropped into a pellet collector 97.

Figure 6:
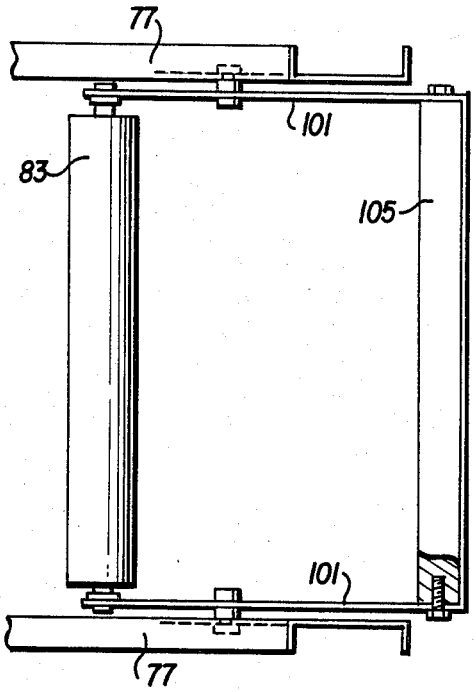
FIG. 6 is a top view of a portion of the apparatus illustrated in FIG. 3.
Figure 8:
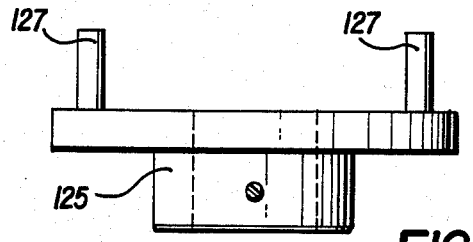
FIG. 8 is a side view of a drive mechanism employed in the FIG. 7 apparatus.
Figure 7:
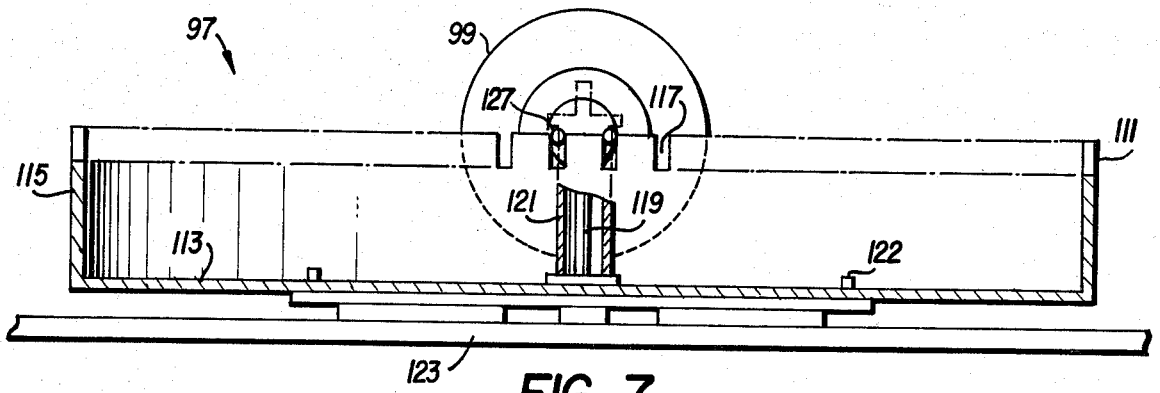
FIG. 7 is a side view of a cuttings collector illustrated in FIG. 3.

Roller 83 of auxiliary conveyor 79 is mounted on a frame 101, which is pivotally mounted to support frame 77 in the manner illustrated in FIG. 6. Roller 83 is mounted on one side of the pivot axis 103 of frame 101, while a counterweight 105 is mounted on the other side of pivot axis 103. The counterweight provides a clockwise biasing force (FIG. 5) to roller 83, pressing it into contact with belt 69 rotating around magnetic drum 67. This biasing provides a positive and secure contact of belt 84 with belt 69 for driving the former by the latter, while, at the same time, allowing for the accommodation of different sized artificial cuttings and/or foreign objects in the nip between the two belts without damage of the belts or drum 67. Thus, a flexible drive mechanism is provided by belts 69 and 84, which accommodates different sizes of artificial cuttings/foreign objects, and which securely removes the cuttings from drum 67.

Scrapers 107 and 109 may be provided for respectively scraping conveyor belts 69 and 84 to remove any residual artificial cuttings therefrom.

Figure 9:
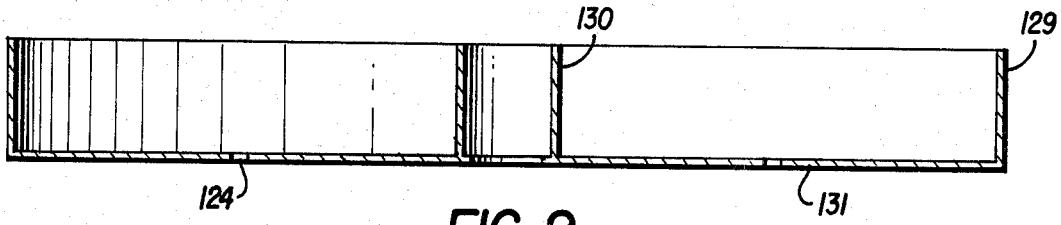
FIG. 9 is a side view of an inner rotary tray used with the apparatus depicted in FIG. 7.

The pellet collector 97 is illustrated in greater detail in FIGS. 7–11. It includes an outer rotary tray 111 and a removable inner rotary tray 129 (FIG. 9). The outer rotary tray includes a round tray bottom 113 and upstanding tray sidewalls 115. Slots 117 are provided on the upper edges of the outer rotary tray for engaging with a drive mechanism, described in greater detail below. The outer rotary tray bottom 113 is fixed to a sleeve 121, which rotates about a stationary spindle shaft 119 mounted on a fixed platform 123. Rotation of outer rotary tray 111 occurs by the engagement of a rotating drive wheel, shown in FIG. 8, with the slots 117. The drive wheel includes drive pins 127, which rotate about the axis of the drive wheel, and alternatively engage with successive slots 117. The drive wheel is driven by the output shaft of a motor 99.

The cuttings collector, as noted, further includes an inner rotary tray 129 which is placed over spindle 119 and sleeve 121 and rests on the bottom of the outer rotary tray 111. To ensure that both the inner and outer rotary trays rotate together, equally circumferentially spaced upstanding guide posts 122 can be provided on the bottom 113 of the outer rotary tray, which mate with corresponding holes 124 provided in the bottom 131 of the inner rotary tray. Alternatively, the projections can be provided at the bottom 131 of the inner rotary tray 129 and the holes in the bottom 113 of the outer rotary tray 111. The equal circumferential spacing of the guide posts and holes allows the inner rotary tray 129 to be placed within and rotatably held to the outer rotary tray 111 at a plurality of different angular positions. The inner rotary tray includes upstanding sidewalls 132, which define the outer periphery thereof and an annular sidewall 130 which surrounds shaft 119 and sleeve 121. The area of the inner rotary tray 129 between the sidewalls 132 and 130 serves as a collection area for artificial drill cuttings.

Figure 10:
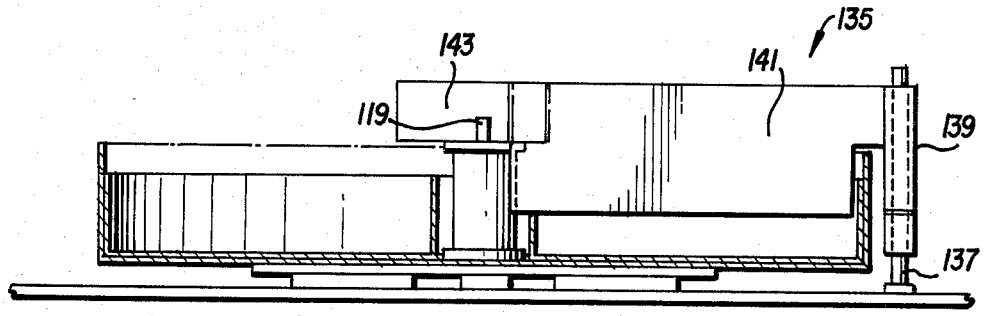
FIG. 10 is a side view of the FIG. 7 collector apparatus fitted with a wiper assembly; and, FIG. 11 is a top view of the wiper assembly illustrated in FIG. 10.
Figure 11:
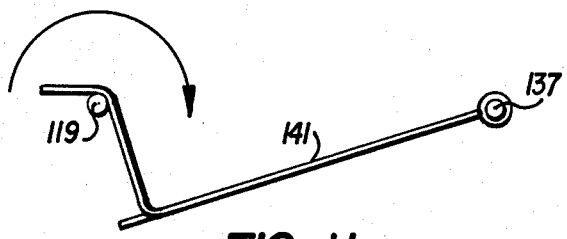

The cuttings collector further includes a wiper assembly, illustrated in FIGS. 10 and 11. A fixed post 137 is provided on a support plate for the cuttings collector and a wiper assembly 135 is provided with a sleeve 139, which fits about post 137. The sleeve is fixably attached to a wiper blade 141, which fits into the area of the inner rotary tray 129 defined by the annular upstanding sidewalls 132 and 130. The wiper blade has an integrally connected stop element 143, which abuts against an extension of the spindle 119. The wiper blade 141 is arranged within the path of rotation of the inner rotary tray 129 and serves to level any artificial cuttings collected by the inner tray. Consequently, both the rotation of the inner tray 129, as well as the wiper blade 141, ensure that the artificial cuttings falling through counter 95 will be uniformly distributed about the cuttings collector. When the cuttings collector, that is the inner rotary tray 129, fills to a predetermined capacity, the wiper assembly 135 and inner tray 129 can be removed and the cuttings recycled back to the artificial cuttings feeder 27 (FIG. 1).

Because the rotation direction of the inner and outer rotary trays is clockwise when viewed from above (as in FIG. 11), the movement of the artificial cuttings by the tray will maintain the wiper blade 141 in the positon illustrated in FIG. 11.

The apparatus described above, as well as the operation thereof, enables both an economical and reliable separation of the artificial cuttings introduced into the drilling mud from a mixture of both artificial and natural drill cuttings contained in returning drilling mud from a downhole location. The artificial drill cuttings can be counted for total amount or by rate (over time) to provide an indication, when compared with the rate or number of artificial cuttings injected into the drilling mud, of whether a cuttings bed is increasing or decreasing in size or remaining substantially stable during a drilling operation.

Drum 67 preferably comprises an outer circumferential surface formed of magnetic material as described above; however, it is also possible to magnetize the outer circumferential surface of drum 67 by means of an internal electromagnet. Drum 67 can also be constructed with a plurality of internal electromagnets each magnetizing a respective circumferential sector of the drum surface. With the latter arrangement, each electromagnet could be energized to magnetize its respective drum sector for that portion of the rotation of the drum wich occurs between the point where the material mixture is received to the point of the nip defined by endless belts 69 and 84. At all other times the respective drum sector would be demagnetized. As another variation, endless belt 69 need not encircle drum 67 but instead can encircle a roller forming a conveyor output which cascades materials onto the magnetized outer surface of drum 67.

Although the invention has been described above with respect to specific operations and structures, it should be apparent that many modifications can be made to the invention without departing from its spirit and scope. Accordingly, the invention is not to be considered as limited by the foregoing description, but is only limited by the scope of the claims appended hereto.

We claim:

1. An apparatus for separating artificial drill cuttings from a mixture containing artificial drill cuttings having predetermined magnetic properties and other drill cuttings not having said predetermined properties, comprising:

conveyor means including a first endless belt positioned for carrying magnetic artificial cuttings and non magnetic cutting on its upper surface and feeding said mixture to one end of the first belt;

a rotating drum at said one end of said first belt about which said first belt passes, said rotating drum being magnetized over at least a portion of its circumferential peripheral surface, said drum attracting and holding said artificial drill cuttings to said first belt by means of its magnetization and not holding said other drill cuttings to said first endless belt so that said other drill cuttings fall off the end of the first belt as it passes over the drum;

means for collecting said other drill cuttings which are not held to said first belt;

a second endless belt positioned so as to carry the artificial drill cuttings and extending generally parallel to said first belt over at least part of its length and forming a nip with said first endless belt at a position adjacent said drum for carrying the artificial drill cuttings between it and said first endless belt, and means spaced from said drum for collecting artificial drill cuttings carried from said first endless belt.

2. An apparatus as in claim 1, further comprising means for counting the artificial drill cuttings removed from said drum.

3. An apparatus as in claim 1, wherein said second endless belt is positioned and arranged to receive said artificial drill cuttings removed from said first endless belt and to transport them to said collecting means.

4. An apparatus as in claim 1, further comprising a separator apparatus for separating a portion of said natural drill cuttings from said mixture and for applying the remainder of said mixture to said conveyor means.

5. An apparatus as in claim 4, including a borehole for supplying said mixture and further comprising:

means for supplying said mixture as received from said borehole and carried by a drilling mud;

mud separation means for separating said mixture from said drilling mud; and means for supplying said mixture to said separator apparatus.

6. An apparatus as in claim 4, wherein said second endless belt revolves about at least two spaced rollers, one of said rollers having a fixed axis, the other of said rollers having an axis supported by a pivotal arm, means for biasing said pivotal arm such that said other roller is moved toward said first endless belt.

7. An apparatus as in claim 6, wherein said biasing means on said pivot arm comprises a counterweight.

8. An apparatus as in claim 1, wherein said means for collecting comprises a rotary tray apparatus rotatable about a center axis thereof and disposed to receive said artificial drill cuttings removed from said first endless belt.

9. An apparatus as in claim 8, wherein said rotary tray apparatus comprises a first outer circular tray and a second inner circular tray removably mounted within said outer circular tray.

10. An apparatus as in claim 9, wherein said rotary tray apparatus further comprises a motor and drive means coupling the output of said motor to drive said outer rotary tray.

11. An apparatus as in claim 10, wherein said outer rotary tray comprises a bottom and a circular upwardly directed sidewall having slots provided in the upper edge thereof, said drive means comprising means coupled to said motor for engaging with said slots to drive said outer rotary tray in rotation.

12. An apparatus as in claim 11, further comprising a wiper positioned and arranged for leveling artificial drill cuttings collected on said rotary tray apparatus.

13. An apparatus as in claim 1, wherein the entire circumferential peripheral surface of said drum is magnetized.

14. A method for separating artificial drill cuttings from a mixture containing artificial drill cuttings having predetermined magnetic properties and other drill cuttings not having said predetermined magnetic properties, comprising:

conveying said mixture by a first endless belt to a rotating drum at one end of said first endless belt;

passing said first endless belt about the outer circumferential surface of said rotating drum, said outer circumferential surface being magnetized over at least a portion of its extent, said outer circumferential surface of said drum attracting and holding said artificial drill cuttings to said first endless belt by means of its magnetization and not holding said other drill cuttings to said first endless belt;

collecting said other drill cuttings which are not held to said first endless belt;

removing artificial drill cuttings held to said first endless belt by said drum from said drum by means of a second endless belt extending parallel to said first endless belt over at least a portion of its length and contacting with said first endless belt at a position adjacent said drum by carrying said artificial cutting between said two belts;

collecting artificial drill cuttings removed from said drum from said second endless belt.

15. A method as in claim 14, further comprising counting the artificial drill cuttings removed from said drum.

16. A method as in claim 14, wherein said second endless belt receives said artificial cuttings removed from said first endless belt and transports them for collection.

17. A method as in claim 14, further comprising the step of preliminarily separating a portion of said natural drill cuttings from said mixture and conveying the remainder of said mixture to said rotating drum.

18. A method as in claim 14, further comprising:

supplying a drilling mud containing said mixture;

separating said mixture from said drilling mud; and separating a portion of said natural drill cuttings from said mixture and conveying the remainder of said mixture to said rotating drum.

19. A method as in claim 14, wherein said second endless belt revolves about at least two spaced rollers, one of said rollers having a fixed axis, the other of said rollers having an axis supported by a pivotal arm, and further comprising the step of biasing said pivotal arm such that said other roller is moved toward said first endless belt.

20. A method as in claim 14, wherein the entirety of said outer circumferential surface is magnetized.

* * * * *